United States Patent [19]

Otto

[11] Patent Number: 4,643,643

[45] Date of Patent: Feb. 17, 1987

[54] APPARATUS FOR ADJUSTING AND LOCKING PITCH OF A VARIABLE PITCH PROPELLER ON A SHIP

[75] Inventor: Wilhelm Otto, Seevetal, Fed. Rep. of Germany

[73] Assignee: Blohm & Voss AG, Hamburg, Fed. Rep. of Germany

[21] Appl. No.: 733,869

[22] Filed: May 14, 1985

[30] Foreign Application Priority Data

May 14, 1984 [DE] Fed. Rep. of Germany ..... 3417853

[51] Int. Cl.[4] ..... B63H 3/08; B63H 3/12

[52] U.S. Cl. ..... 416/154; 416/158; 416/207

[58] Field of Search ..... 416/153, 154, 147, 157 R, 416/158, 207

[56] References Cited

U.S. PATENT DOCUMENTS

| | | | |
|---|---|---|---|
| 2,282,297 | 5/1942 | Keller | 416/154 |
| 2,702,602 | 2/1955 | Van Ommeren | 416/158 |
| 2,958,382 | 11/1960 | Covert et al. | 416/154 |
| 2,981,338 | 4/1961 | Hindmarch | 416/207 X |
| 3,034,584 | 5/1962 | Hindmarch | 416/154 |
| 3,557,744 | 1/1971 | Herbert | 416/207 X |
| 3,711,220 | 1/1973 | Ramback et al. | 416/158 X |
| 3,746,466 | 7/1973 | Dallach et al. | 416/153 |
| 3,895,598 | 7/1975 | Blickle | 115/35 |
| 4,142,829 | 3/1979 | Inoue et al. | 416/25 |
| 4,229,141 | 10/1980 | de Francisco Mesado | 416/157 |
| 4,540,341 | 9/1985 | Wührer | 416/158 X |

FOREIGN PATENT DOCUMENTS

| | | | |
|---|---|---|---|
| 223444 | 12/1958 | Austria | 416/154 |
| 878906 | 6/1953 | Fed. Rep. of Germany . | |
| 996607 | 12/1951 | France | 416/167 |
| 1368675 | 10/1974 | United Kingdom | 416/158 |
| 165389 | 1/1965 | U.S.S.R. | 416/153 |
| 214726 | 8/1968 | U.S.S.R. | 416/154 |

*Primary Examiner*—Everette A. Powell, Jr.
*Attorney, Agent, or Firm*—Nils H. Ljungman

[57] ABSTRACT

Apparatus for adjusting and locking the pitch of a variable pitch propeller. Within a propeller shaft, a hydraulic piston is provided which drives a rod, a plate, and levers to rotate the propeller blades in, and with respect to, the hub of the propeller. The root of the propeller within the hub has a conical portion which has a mating conical ring thereabout. This conical ring is engaged and locked into place with the conical portion of the propeller root and the propeller hub by hydraulic oil pressure, once the optimum pitch of the propeller blades is determined.

12 Claims, 4 Drawing Figures

APPARATUS FOR ADJUSTING AND LOCKING PITCH OF A VARIABLE PITCH PROPELLER ON A SHIP

BACKGROUND OF THE INVENTION

1. Field of the Invention

The invention relates to an arrangement for adjusting the pitch of a ship's propeller, and more particularly, for adjusting and locking the pitch of the ship's propeller.

2. Description of the Prior Art

Variable or adjustable pitch propellers for ships are well known in the prior art. The following are some examples of prior art:

U.S. Pat. No. 3,895,598 shows a ship propulsion unit which comprises a variable pitch propeller supported in a hub. A plurality of annular chambers are defined, through which pass a number of supply and return lines for several fluid pressure systems which lead to the propeller and a servo motor for adjusting the pitch of the propeller blades.

U.S. Pat. No. 4,142,829 relates to a compound remote control device for controlling the pitch of a variable-pitch propeller on a ship's drive mechanism while, at the same time, controlling the speed of the ship's engine, and provides a control mechanism for compound control under various control conditions, using one cam and a pressure-control valve cooperating therewith. With this control device, control of the speed of the aforesaid engine and the control of the pitch of the variable-pitch propeller are carried out by using air-pressure signals under various control conditions, that is, where the relationship of the various control air pressures in relation to the position of the control lever varies.

U.S. Pat. No. 4,229,141 shows a propeller comprising a hub having a rotating fitting mounted on the central end part thereof, which permits the passage therethrough of a fluid circulating within two conduits which pass longitudinally of the fitting. The fluid operates on opposite ends of an annular piston to impart thereto rectilinear movement, which in turn is transformed into rotation of the blades of the propeller, due to lugs extending from the piston and being eccentrically engaged with the blades. The hub of the propeller is completely free to turn without affecting the driving shaft. The assembly is positioned completely outside the stern of the ship.

Another example of the prior art is German Pat. No. DE-PS 878 906, which relates to an adjustable pitch propeller which can be adjusted and the setting maintained. All of the above-cited patents are incorporated herein by reference.

OBJECT OF THE INVENTION

It is an object of the invention to relieve the machine driven adjusting device in the propeller from the stresses which occur while the propeller is operational after the most favorable pitch has been ascertained, that is, to fix the propeller blades in the determined setting after terminating the trial run.

SUMMARY OF THE INVENTION

The invention relates broadly to an apparatus for adjusting and locking a pitch of a variable pitch propeller when installed on a ship. The apparatus is made up of a plurality of variable pitch propeller blade assemblies rotatably mounted in a propeller blade hub. The propeller blade hub is designed to be mounted on a propeller shaft of a ship. An arrangement is provided for rotating the rotatable propeller blade assemblies in the propeller blade hub with each of said propeller blade assemblies having a conical portion disposed in the propeller blade hub. A control arrangement is provided for controlling the adjustment of the pitch of the propeller blade assemblies. A locking arrangement is provided which locks the propeller blade assemblies in the propeller blade hub. The locking arrangement includes, on each propeller blade assembly, a ring having an inner, annular conical surface. This conical surface of the conical ring is disposed about the conical portion of the corresponding propeller blade assembly and is disposed adjacent to the conical portion of its corresponding propeller blade hub. The conical portion of the corresponding propeller blade assembly has a conical pitch which is similar and mates with the conical surface of its corresponding conical ring. There is also provided a locking arrangement for pressing into engagement and locking the inner conical surface of each conical ring with the conical portion of its corresponding propeller blade assembly, whereby each of the propeller blade assemblies is firmly, non-rotatably engaged and locked in the propeller blade hub.

In the process of locking the propeller blades in a determined setting in the first embodiment of the invention, the self-locking ring is pressed in, from a direction from the outside perimeter of the hub, between the shoulder journal and the hole in the propeller hub which receives it. In this embodiment, the self-locking ring is pressed in when the ship is in a dock, such as a dry dock, or with the aid of a diver, such as a scuba diver. In a further embodiment of the invention, provisions are made to carry out this procedure from the interior of the ship, preferably when the propeller shaft is at rest, eliminating the need for a dock or a diver. Adjustment of the propeller blade assemblies is done with the aid of an apparatus which is located within the propeller shaft and which is eccentrically attached to a shoulder journal of such propeller blade assemblies for rotation and adjustment thereof. Thus, this invention relates generally to a pitch optimizable installed propeller which may have its pitch adjusted and locked, based on test-run results obtained with the installed propeller. In other words, the invention relates to a propeller whose pitch can be adjustably improved and then maintained in its improved setting.

BRIEF DESCRIPTION OF THE DRAWINGS

The invention will be described in greater detail in the following, on the basis of an embodiment given by way of example and illustrated in the appended drawings, in which.

DESCRIPTION OF THE PREFERRED EMBODIMENTS

Figure 1:
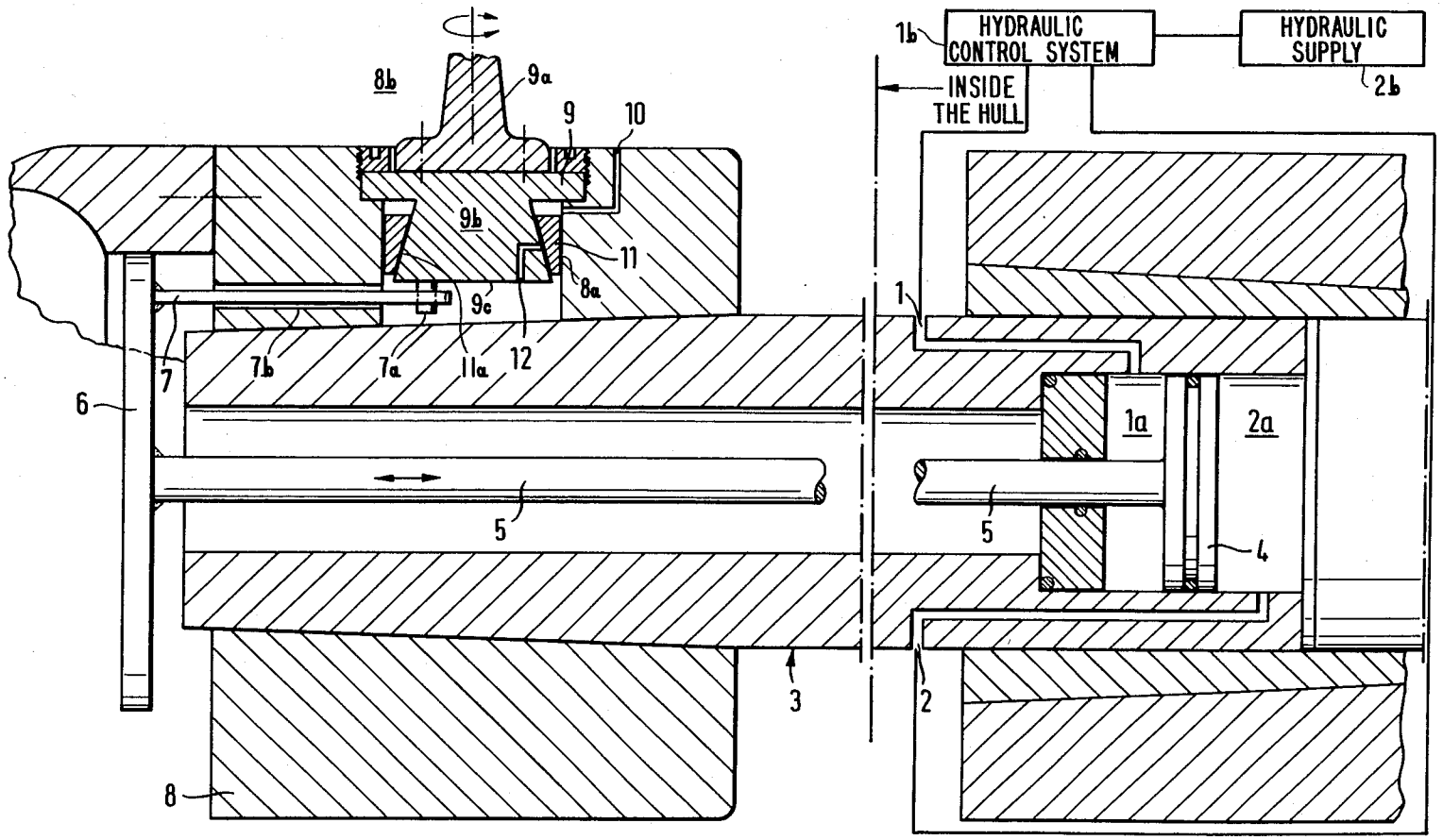
FIG. 1 shows a longitudinal cross-section through an arrangement which is in accordance with the invention.
Figure 2:
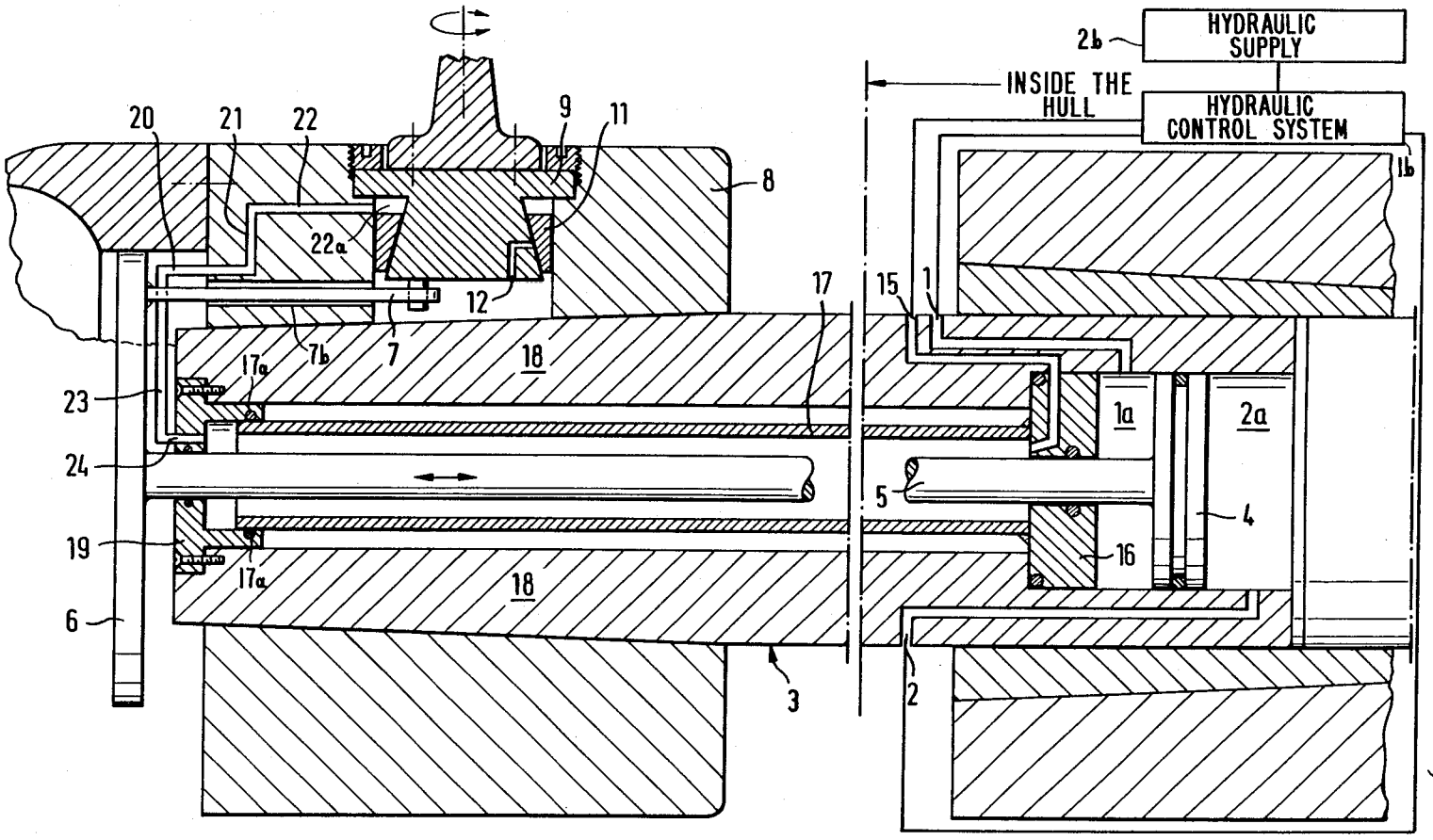
FIG. 2 shows a similar cross-section as in FIG. 1, but with the features according to an alternative embodiment of the invention.

FIG. 1 shows a first embodiment of the invention having a propeller shaft 3 with a piston 4 contained in a cylinder therein. The piston 4 has cylinder chambers 1*a* and 2*a* disposed on either side thereof which are filled with hydraulic oil. Depending on whether the pitch of the propeller is to be increased or decreased, oil is fed from the interior of the ship through the holes 1 or 2 into the corresponding cylinder chambers 1*a* or 2*a* by operation of a hydraulic control system 1*b* which controls hydraulic oil under pressure received from a hydraulic supply 2*b*, as shown in FIG. 2. These cylinder chambers 1*a* and 2*a* are preferably located within the bored-out propeller shaft 3. The piston 4, which is acted upon by the oil under pressure, moves, together with its attached piston rod 5, in the forward or backward direction, that is, to the left and to the right in FIG. 1. Mounted on the end of the piston rod 5 is a distribution plate 6 which, with the aid of levers or jacks 7 which pass through the propeller hub 8, or are connected to lugs or bosses 7*a* protruding from a bottom 9*c* of a blade root shoulder 9*b*, effect a rotation of typically a number of shoulder journals 9, attached to blade roots 9*b*, for rotation of propeller blades 9*a*. For improved clarity, only one of these blade assemblies is shown in FIG. 1. Alternate arrangements for controlling and varying the pitch of the propeller blades 9*a* are taught in U.S. Pat. Nos. 3,895,598, 4,142,829, and 4,229,14, which patents are incorporated herein by reference.

For the final clamping and the fixing of the position of the shoulder journal 9 and its corresponding propeller blade assembly 8*b* in the propeller hub 8, pressurized oil is fed into a hole 10 in the propeller hub 8, causing a conical ring 11, disposed about a conical portion 11*a* of the blade root shoulder 9*b*, to be pushed in an axial direction towards the piston rod 5. This process causes the shoulder journal 9 to be clamped in the propeller hub 8. In this embodiment, release of this compression or slip-joint, formed by the conical ring 11 and the conical portion 11*a* of the blade root shoulder 9*b* can only be effected after the propeller has been removed from the propeller shaft 3. The release of the conical ring 11 being effected by introducing oil under pressure into a hole 12 in the propeller hub 8 under a surface between the conical ring 11 and the conical portion 11*a*. By means of this procedure, the conical ring 11 is surrounded by the pressurized oil and forced outwards in an outwardly radial direction away from the piston rod 5. As is well known in the art, the conical pitch of the conical ring 11, along with its mating conical portion 11*a* of the blade root shoulder 9*b*, is chosen so that the conical ring 11 and its mating conical portion 11*a* are self-locking when engaged by action of the pressurized oil admitted through the hole 10. The outer surface 11*b* of the conical ring 11 may also be conically shaped in order to better grip, in a self-locking manner, a conically mating inner portion 8*a* of the propeller hub 8, in a way similar to the engaging of the conical ring 11 with the blade root shoulder 9*b* as mentioned above.

In order to make the pitch varying apparatus as light as possible, in another alternative embodiment of the invention, optimum operation of the pitch varying apparatus and the locking arrangement may preferably be done when the propeller is stationary, thereby reducing the effects of thrust, vibration and centrifugal force.

FIG. 2 shows an alternative embodiment of the invention, where in order to fix or lock the shoulder journal 9 in the propeller hub 8 from the interior of the ship, the pressurized oil must pass through the hole 15 in a cover 16 of the cylinder chamber 1*a*. The hole 15 is preferably displaced by 90° with respect to the hole 1 (as seen in FIG. 1).

Figure 3:
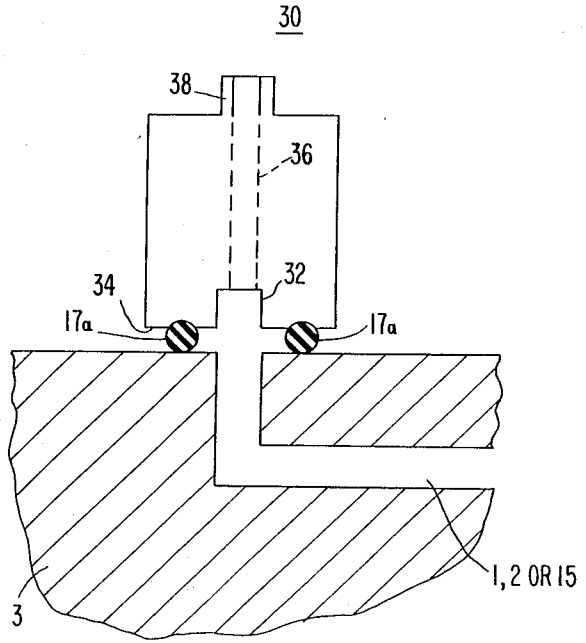
FIG. 3 shows a partial cross-section of a portion of FIGS. 1 and 2 in accordance with the invention.

Referring now to FIG. 3, the oil for the holes 1, 2 and 15 is preferably provided by oil rings 30 which extend about and encircle the propeller shaft 3. Only a portion of one of the oil rings 30 is shown in FIG. 3. The oil rings 30 have internal annular grooves 32 cut into an inner annular surface 34 thereof and seals 17*a* to retain oil in the grooves 32. A hole 36 extends from a peripheral portion of the oil rings 30 into the annular groove 32 of the oil rings 30, and has a nipple attachment 38 for connection to an oil conduit from the hydraulic control system 1*b*.

Referring once again to FIG. 2, welded to the cover 16 for the cylinder chamber 1*a* is a tube 17 for containing oil from the hole 15 as the hydraulic oil flows into the tube 17. The pressurized oil passes through the hole 15 in the cover 16 and into the tube 17. The tube 17 is provided with an end-cap 19, being screwed into a conical portion 18 of the propeller shaft 3 for receiving the propeller hub 8. The end-cap 19 terminates and seals off the tube 17. Seals 17*a* in the end cap 19 permit some movement of the tube with respect to the end cap 19.

The pressurized oil then accordingly flows through a hole 24 in the and cap 19; into a connecting pipe-line 23; through the holes 20, 21 and 22; and into the interspace 22*a* between the shoulder journal 9 and the conical ring 11. The interspace 22*a* is shown as being above the conical ring 11 in FIG. 2. The hydraulic oil thereby presses the conical ring 11 firmly into place against the blade root shoulder 9*b*. In an alternative embodiment of the invention, a radial thickness of the conical ring 11 may be chosen so that the conical ring 11 expands when it is seated firmly in place against the blade root shoulder 9*b*, and also firmly engages against the inner portion 8*a* of the propeller hub 8.

Seals, provided to prevent leakage of the pressurized oil, are located around the piston 4, and are also disposed around the cover 16 and the end cap 19.

Figure 4:
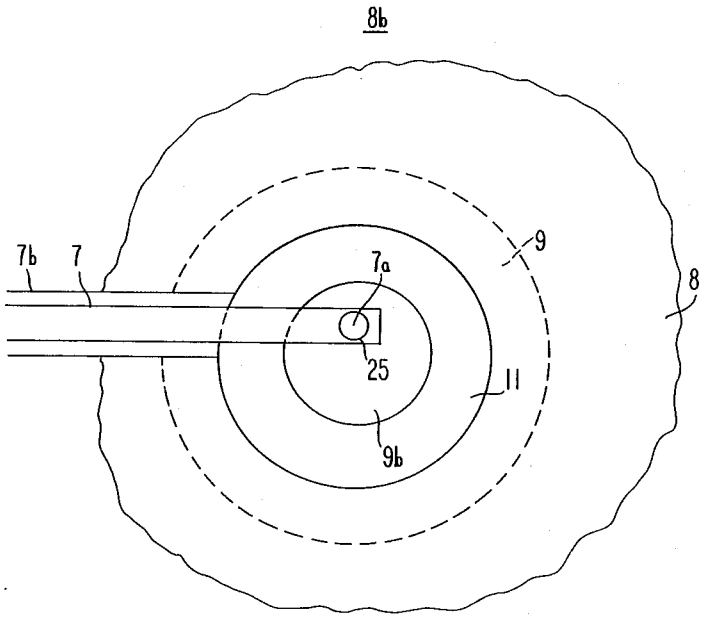
FIG. 4 shows a bottom view of a portion of a propeller blade assembly in accordance with the invention.

FIG. 4 shows a bottom view of the propeller blade assembly 8*b*, as seen in FIGS. 1 and 2. The lug or boss 7*a* extends from the bottom of the blade root shoulder 9*b*. This lug 7*a* engages with a hole 25 in an end of the lever 7, which level 7 is located adjacent to the blade root shoulder 9*b*. The lever 7 is preferably held on the lug 7*a* by using a series of self-locking nuts threaded upon threads (not shown) on the lug 7*a*. In order to provide rotary movement of each propeller blade assembly 8*b*, the holes 25 preferably have some play with respect to their corresponding lugs 7*a*. The lever 7 may also be flexible and bend when the propeller blade assembly 8*b* is rotated. Additionally, a play is provided about the lever 7 in a hole 7*b* thereabout, as shown in FIGS. 1 and 2. The play between the lever 7 and the hole 7*b* allows the lever 7 to follow the lug 7*a* during rotation without undue flexure of the lever 7.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for optimizing pitch of a propeller by adjusting and substantially permanently locking the pitch of a propeller when said propeller is installed on a ship and said propeller is substantially stopped, said apparatus comprising:

a plurality of variable pitch propeller blade assemblies rotatably mounted in a propeller blade hub, said propeller blade hub for being mounted on a propeller shaft of a ship;

means for rotating said plurality of rotatable propeller blade assemblies in said propeller blade hub only when said propeller and its propeller shaft are substantially stopped;

each said propeller blade assembly having a longitudinal axis, said longitudinal axis extending from said propeller hub outwardly therefrom to a tip portion of its corresponding propeller blade;

each of said propeller blade assemblies having a conical portion disposed in said propeller blade hub;

means for being disposed within said ship for controlling said rotating means, said controlling means for controlling said rotating means during adjustment of said pitch of said propeller blade assemblies;

means for locking said plurality of propeller blade assemblies only when said propeller and its propeller shaft are substantially stopped in said propeller blade hub and for substantially permanently locking said blade assemblies in said hub, said locking means comprising: on each said propeller blade assembly, a ring having an inner, annular conical surface, each said propeller blade assembly having a propeller blade root with a conical portion, said conical surface of said conical ring being disposed about said conical portion of the corresponding propeller blade assembly, said conical surface of said conical ring being disposed adjacent to said conical portion of its corresponding propeller blade root, said conical portion of the corresponding propeller blade assembly having a substantially similar conical pitch as, and substantially mating with, said conical surface of its corresponding conical ring;

each said ring having an outer, annular surface opposite said inner annular surface, said outer surface having means to be engaged with said hub, said hub having means to be engaged with said means to be engaged of said outer annular surface of each said ring;

means for pressing into engagement and locking said inner conical surface with its corresponding conical portion of its corresponding propeller blade assembly and said means to be engaged of said outer surface of each said conical ring with its means to be engaged of said hub, whereby each of said propeller blade assemblies is firmly, non-rotatably engaged and locked in said propeller blade hub;

said means for rotating said propeller blade assemblies comprising means for rotating said propeller blade assemblies over a portion of a blade rotation substantially less than a complete blade rotation;

each said propeller blade having its root disposed in said propeller blade hub;

said means for rotating said propeller blade comprising:

a journal protruding, at a peripheral portion, from each said propeller blade root, said journal rotating with its corresponding propeller blade root about a corresponding longitudinal axis of its corresponding blade, each said journal rotating with its root at a substantially constant distance from its corresponding propeller blade longitudinal axis;

elongated rod means connected to each said journal for rotating each said propeller blade;

a plurality of elongated orifices in said propeller hub for receiving its corresponding elongated rod means, each said elongated rod means having a longitudinal axis;

means for moving each said elongated rod means along its longitudinal axis and through its corresponding orifice;

each said orifice having a given play between an inner surface thereof and an outer surface of its corresponding elongated rod means extending therethrough, thereby providing only limited play, of each said lever in each said corresponding orifice, substantially at right angles to each said longitudinal axis of each said elongated rod means whereby only a limited longitudinal movement of each said elongated rod means is provided for optimizing said propeller pitch over its range of rotation; and said means for pressing each said ring into engagement and locking comprising:

hydraulic means for providing hydraulic oil under pressure;

an end surface on said ring being disposed to be acted upon by said oil under pressure provided by said hydraulic means for substantially permanently locking said ring against said propeller blade assembly and said hub only when said propeller and its propeller shaft are substantially stopped.

2. The apparatus for optimizing pitch of said propeller by adjusting and subsequently substantially permanently locking the pitch of the propeller according to claim 1 wherein said propeller hub has a radially outward disposed portion and a central portion about which said propeller rotates, said rings each having a wider portion that is disposed outwardly toward said radially outwardly disposed portion of said propeller hub, said means for applying oil pressure to said conical ring being disposed to apply said oil pressure to said wider portion of said conical ring to drive said conical ring inwardly and centrally into engagement with said propeller blade hub and said propeller blade root.

3. The apparatus for optimizing pitch of said propeller by adjusting and subsequently substantially permanently locking the pitch of the propeller according to claim 1 wherein means for applying hydraulic oil pressure comprises means for applying oil pressure through said propeller blade hub to said conical ring to drive said conical ring into engagement with said propeller blade root.

4. The apparatus for optimizing pitch of said propeller by adjusting and subsequently substantially permanently locking the pitch of the propeller according to claim 1 wherein each said elongated rod means comprises a lever connected to each said propeller blade assembly.

5. The apparatus for optimizing pitch of said propeller by adjusting and subsequently substantially permanently locking the pitch of the propeller according to claim 3 wherein said means for applying oil pressure comprises a passage for conducting oil under pressure through said propeller blade hub.

6. The apparatus for optimizing pitch of said propeller by adjusting and subsequently substantially permanently locking the pitch of the propeller according to claim 4 wherein said means for applying oil pressure comprises a passage for conducting oil under pressure through said propeller blade hub.

7. The apparatus for optimizing pitch of said propeller by adjusting and subsequently substantially permanently locking the pitch of the propeller according to claim 3 including means for controlling oil pressure, and wherein said means for applying oil pressure comprises a series of passages for leading into an interior portion of said ship for connection to said means for controlling oil pressure.

8. The apparatus for optimizing pitch of said propeller by adjusting and subsequently substantially permanently locking the pitch of the propeller according to claim 7 wherein said control means for controlling said means for applying oil pressure is disposable within said ship.

9. The apparatus for optimizing pitch of said propeller by adjusting and subsequently substantially permanently locking the pitch of the propeller according to claim 3 wherein said means for rotating said propeller blade assemblies includes a piston means and a piston rod means assembly disposed in a hydraulic cylinder, said piston rod means having means for connection to and activation of said levers.

10. The apparatus for optimizing pitch of said propeller by adjusting and subsequently substantially permanently locking the pitch of the propeller according to claim 4 wherein said means for rotating said propeller blade assemblies includes a piston means and a piston rod means assembly disposed in a hydraulic cylinder, said piston rod means having means for connection to and activation of said levers.

11. The apparatus for optimizing pitch of said propeller by adjusting and subsequently substantially permanently locking the pitch of the propeller according to claim 1 including means for hydraulically releasing each said ring when permanently locked against said blade root and said hub.

12. The apparatus for optimizing pitch of said propeller by adjusting and subsequently substantially permanently locking the pitch of the propeller according to claim 11 including means disposed in said ship for activating said means for hydraulically releasing each said ring.

* * * * *